US005213424A

United States Patent [19]

Itoh

[11] Patent Number: 5,213,424

[45] Date of Patent: May 25, 1993

[54] PIEZOELECTRIC ACTUATOR DEVICE

[75] Inventor: Kiyoshi Itoh, Kawasaki, Japan

[73] Assignee: Fujitsu Ltd., Kanagawa, Japan

[21] Appl. No.: 887,813

[22] Filed: May 26, 1992

[30] Foreign Application Priority Data

May 27, 1991 [JP] Japan ..... 3-121311

[51] Int. Cl.[5] .....B41J 2/25

[52] U.S. Cl. ..... 400/124; 400/157.1

[58] Field of Search ..... 400/124, 157.1; 101/93.05

[56] References Cited

U.S. PATENT DOCUMENTS 5,005,994 4/1991 Yano ..... 400/124
5,092,689 3/1992 Yano ..... 400/124

FOREIGN PATENT DOCUMENTS 0193375 11/1982 Japan ..... 400/124
0016767 1/1984 Japan ..... 400/124
0150756 8/1984 Japan ..... 400/124
0000969 1/1985 Japan ..... 400/124
0055159 3/1987 Japan ..... 400/124

*Primary Examiner*—Edgar S. Burr
*Assistant Examiner*—Anthony H. Nguyen
*Attorney, Agent, or Firm*—Armstrong, Westerman Hattori, McLeland & Naughton

[57] ABSTRACT

A piezoelectric actuator device for use in a printing machine and comprising a laminated piezoelectric element sandwiched between first and second blocks, and first and second leaf springs attached to upper and lower surfaces of the first and second blocks for maintaining the laminated piezoelectric element in compression. The laminated piezoelectric element has a width that is equal to or greater than the respective width of the first and second blocks and the first and second leaf springs. The first and second leaf springs have apertures through which leads can extend.

4 Claims, 4 Drawing Sheets

PIEZOELECTRIC ACTUATOR DEVICE

BACKGROUND OF THE INVENTION

1. Field of the Invention

The present invention relates to a piezoelectric actuator device that is used, for example, in a wire-dot printing machine.

2. Description of the Related Art

A wire-dot printing machine comprises a plurality of printing elements each of which includes a printing wire for striking the paper to be printed. With the increased printing speed in the wire-dot printing machine, a piezoelectric actuator device comprising a piezoelectric assembly is often used in the printing element to move the printing wire in response to a given signal. The movement of the piezoelectric assembly is very small and a movement magnifying mechanism is provided in the printing element for magnifying the movement of the piezoelectric assembly and for transferring the magnified movement to the printing wire.

The piezoelectric assembly comprises an elongated laminated piezoelectric element that is comprised of a plurality of thin piezoelectric plates laminated together. The laminated piezoelectric element is sandwiched between first and second blocks, and first and second leaf springs extend between the first and second blocks for maintaining the laminated piezoelectric element in compression. The laminated piezoelectric element has electrodes and leads for connection to an external power supply.

In the printing machine, a plurality of printing elements are arranged in a side-by-side relationship, and accordingly, the piezoelectric assemblies of the printing elements are arranged in a side-by-side relationship. The first and second leaf springs of each printing element are attached to the lateral surfaces of the first and second blocks facing the lateral sides of the laminated piezoelectric element. Therefore, the width of the piezoelectric assembly is defined by the width of one of the first and second blocks plus the width of the two leaf springs, and the total width is greater than the width of the laminated piezoelectric element.

It is desirable for the piezoelectric assembly of printing element have a thin width so that more and more printing elements are densely arranged.

SUMMARY OF THE INVENTION

One object of the present invention is to solve the above described problems and to provide a piezoelectric actuator device comprising a piezoelectric assembly having a thin width.

Another object of the present invention is to provide a piezoelectric actuator device in which a piezoelectric assembly has leaf springs for maintaining the laminated piezoelectric element in compression and the leaf springs are designed to increase the possibilities of the piezoelectric actuator device.

According to the present invention, there is provided a piezoelectric actuator device comprising a laminated piezoelectric element having first and second opposite ends and first and second opposite sides, a first block located at the first end of the laminated piezoelectric element, a second block located at the second end of the laminated piezoelectric element, a first leaf spring arranged between the first and second blocks facing the first side of the laminated piezoelectric element, and a second leaf spring arranged between the first and second blocks facing the second side of the laminated piezoelectric element; the first and second leaf springs maintain the laminated piezoelectric element in compression, wherein the laminated piezoelectric element has a width measured on the first and second opposite sides, and the first and second blocks and the first and second leaf springs have respective widths measured on the first and second opposite sides; the width of the laminated piezoelectric element being equal to or greater than the respective width of the first and second blocks and the first and second leaf springs.

With this arrangement, it is possible to provide for a thin piezoelectric actuator assembly and to arrange more and more piezoelectric actuator assemblies in a dense arrangement.

According to the other aspect of the present invention, there is provided a piezoelectric actuator device comprising a laminated piezoelectric element having first and second opposite ends and first and second opposite sides, a first block located at the first end of the laminated piezoelectric element, a second block located at the second end of the laminated piezoelectric element, a first leaf spring arranged between the first and second blocks facing the first side of the laminated piezoelectric element, and a second leaf spring arranged between the first and second blocks facing the second side of the laminated piezoelectric elements; the first and second leaf springs maintain the laminated piezoelectric element in compression, wherein the laminated piezoelectric element has at least one lead means extending therefrom to an external power source, and at least one of the first and second leaf springs has an aperture through which at least one lead means extends.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
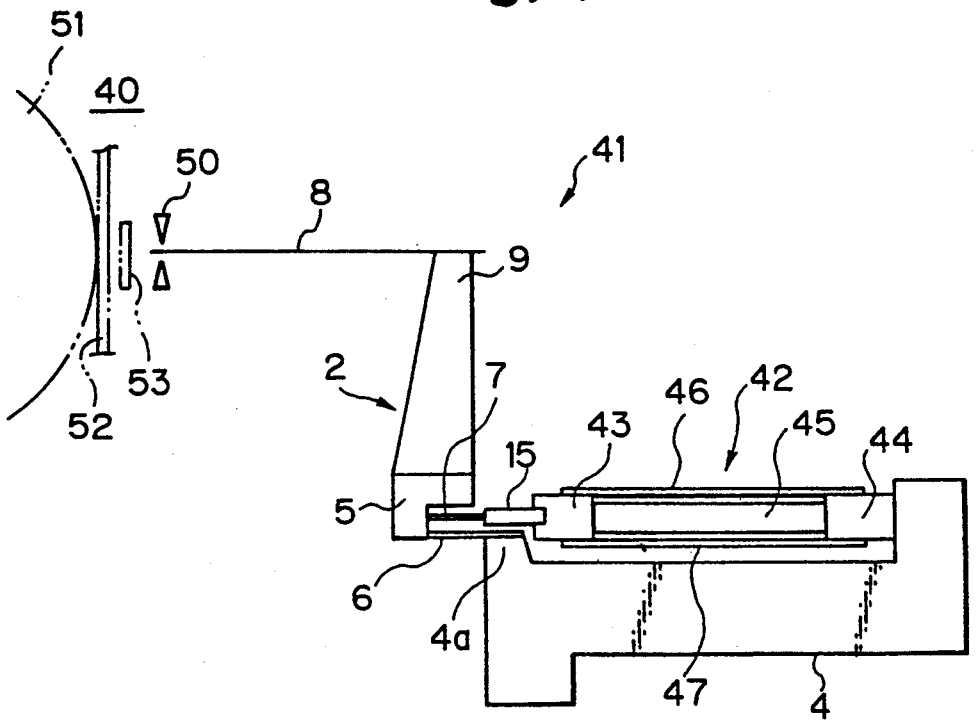
FIG. 1 is a diagrammatic side view of a printing element incorporating a piezoelectric actuator device according to one embodiment of the present invention.
Figure 5:
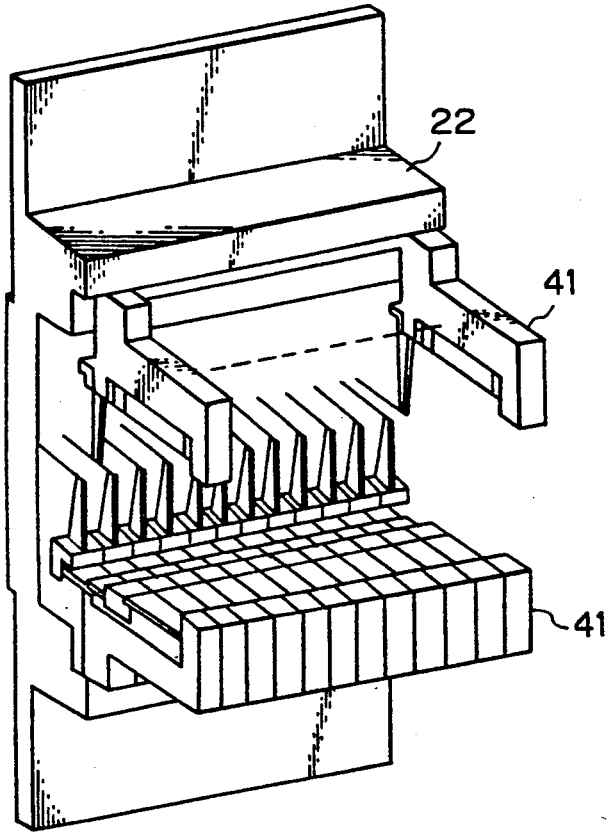
FIG. 5 is a partially broken perspective view of a printing head module comprising a plurality of printing elements of FIG. 1.
Figure 6:
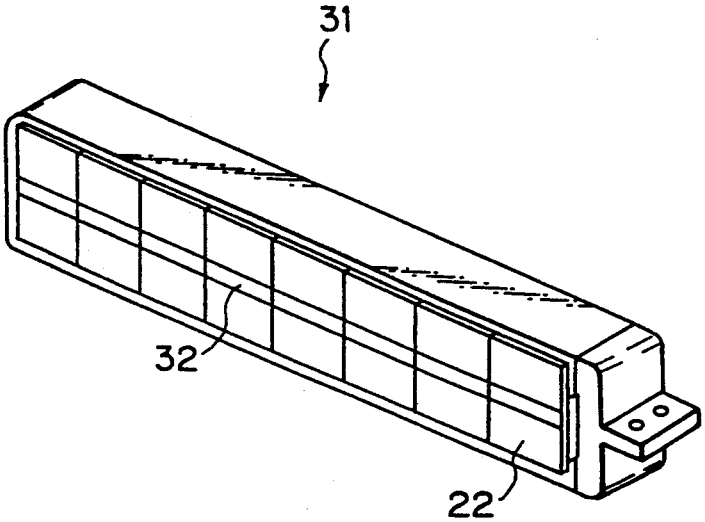
FIG. 6 is a perspective view of a printing head unit comprising a plurality of printing head modules of FIG. 5.

FIG. 1 shows a printing machine with a printing element 41. In FIG. 5, twenty four printing elements 41 are mounted in two rows to an element mounting frame 22 to form a printing head module 21. In FIG. 6, eight printing head modules 21 (shown by the element mounting frames 22) are further assembled on a printing head unit 31. The numeral 32 in FIG. 6 shows a wire guide portion provided in the element mounting frames 22. The printing head unit 31 may be mounted on a printing machine, such as a shuttle printer having a reciprocating shuttle.

Figure 2:
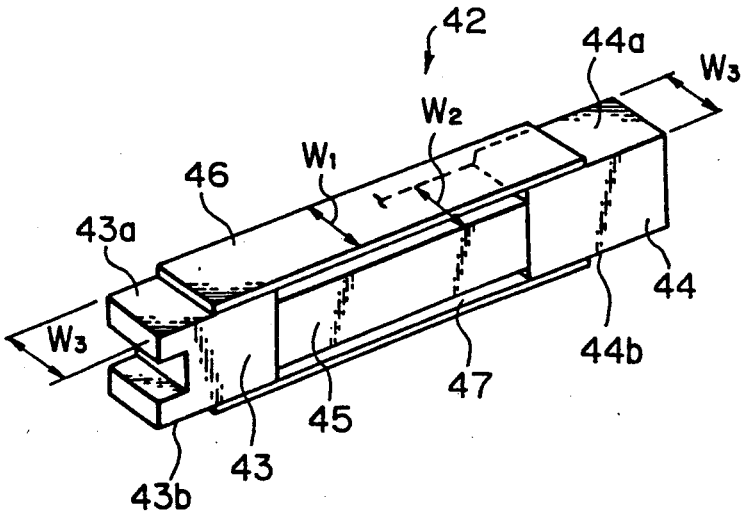
FIG. 2 is a perspective view of the piezoelectric assembly of FIG. 1.

In FIGS. 1 and 2, the printing element 41 comprises a printing wire 8 that is guided in a wire guide 50 in the printing machine. The printing machine includes a platen 51 on which paper 52 to be printed is fed. The printing wire 8 can strike the paper 52 via an ink ribbon 53 when the printing wire 8 is activated.

The printing element 41 includes a piezoelectric actuator device comprising a stationary base 4, a piezoelectric assembly 42 and a movement magnifying mechanism 2. The piezoelectric assembly 42 comprises an elongated laminated piezoelectric element 45 that is comprised of a plurality of thin piezoelectric plates 45*a* laminated together via intermediate electrode layers 45*b* arranged between the adjacent piezoelectric plates 45*a*, as shown in FIG. 4. Side electrode layers 45*c* and 45*d* are provided on the opposite sides of the laminated piezoelectric element 45 to connect the alternating intermediate electrode layers 45*b* to the power source (not shown) via leads (such as 48 and 49 in FIG. 3), with insulating elements 12*e* arranged in staggered positions at the junctures between the intermediate electrode layers 12*b* and the side electrode layers 12*c* and 12*d*.

As shown in FIGS. 1 and 2, the laminated piezoelectric element 45 is longitudinally sandwiched by metal blocks 43 and 44. First and second leaf springs 46 and 47 are provided between the metal blocks 43 and 44 to maintain the laminated piezoelectric element 45 in compression. The first and second leaf springs 46 and 47 are fixed to the opposite surfaces of the metal blocks 10 and 11. In particular, the first leaf spring 46 faces an upper surface of the laminated piezoelectric element 45 and is attached at one end thereof to an upper surface 43*a* of the first metal block 43 and at the other end thereof to an upper surface 44*a* of the second metal block 44 by a laser welding or the like while the first leaf spring 46 is held in tension. Also, the second leaf spring 47 faces a lower surface of the laminated piezoelectric element 45 and is attached at one end thereof to a lower surface 43*b* of the first metal block 43 and at the other end thereof to a lower surface 44*b* of the second metal block 44 by a laser welding or the like while the second leaf spring 47 is held in tension. A connecting plate 15 is attached to the metal block 10.

As shown in FIG. 2, the laminated piezoelectric element 45 has a width $W_2$ measured on the upper or lower surface thereof. Each of the first and second metal blocks 43 and 44 has a width $W_3$ and each of the first and second leaf springs 46 and 47 has width $W_1$. According to the present invention, the width $W_2$ of the laminated piezoelectric element 45 is equal to or greater than the respective width $W_3$ or $W_1$ of the first and second metal blocks 43 and 44 and the first and second leaf springs 46 and 47. Therefore the width of the piezoelectric assembly 42 is as thin as the width $W_2$ of the laminated piezoelectric element 45.

As shown in FIG. 1, the metal block 44 at one end of the piezoelectric assembly 3 is fixed to and supported by the stationary base 4 of the piezoelectric actuator device. The connecting plate 15 at the other end of the piezoelectric assembly 3 is connected to the movement magnifying mechanism 2. The movement magnifying mechanism 2 has an armature 5 and an upwardly elongated beam 9 attached to the lower end of the armature 5. The printing wire 8 is carried at the upper end of the upwardly elongated beam 9. The movement magnifying mechanism 2 has a first support spring 7 connecting the connecting plate 15 of the piezoelectric assembly 3 to the armature 5 and a second support leaf spring 6 connecting the armature 5 to the stationary base 4. The stationary base 4 is generally U-shaped. The second support leaf spring 6 is carried at an upper surface of one upright portion 4*a* of the U-shaped stationary base 4 and the piezoelectric assembly 3 is carried at an inner surface of the other upright portion of the U-shaped stationary base 4 so that the second support leaf spring 6 is parallel to the piezoelectric assembly 3. The first support leaf spring 7 is in line with the piezoelectric assembly 3 and thus parallel to the first support leaf spring 7. The gap between the first and second support leaf springs 6 and 7 is typically 0.4 to 0.6 millimeters, and the gap between the second support leaf springs 7 and the connecting plate 15 is typically 0.2 millimeters.

In operation, when an electric voltage is supplied to the laminated piezoelectric element 45, it expands toward the armature 5 of the movement magnifying mechanism 2 by tens of units of microns, for example. The movement of the laminated piezoelectric element 45 is transferred to the armature 5 by the first support leaf spring 6, and the armature 5 with the upwardly elongated beam 9 is moved pivotally on the second support leaf spring 7 in a plane perpendicular to the upper and lower surfaces of the laminated piezoelectric element 45 and therefore, the printing wire 8 extends to the ink ribbon 53 and the paper 52, by approximately 100 micron, for example, to print a dot on the paper 52. The electric voltage is then released and the laminated piezoelectric element 45 retracts to the original position to return the movement magnifying mechanism 2 and the printing wire 8 to the respective original positions.

Figure 3:
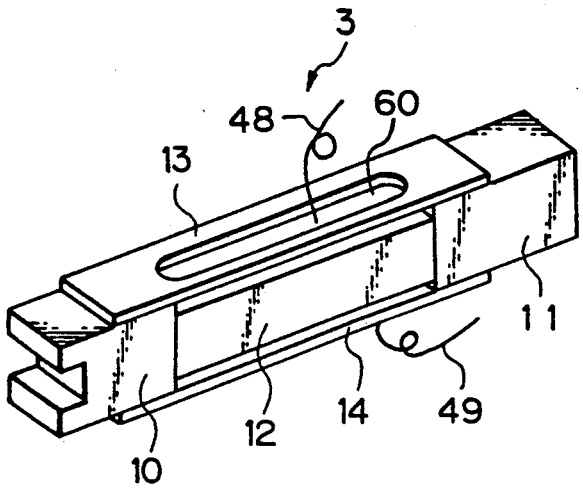
FIG. 3 is a perspective view of the piezoelectric assembly according to another embodiment.
Figure 4:
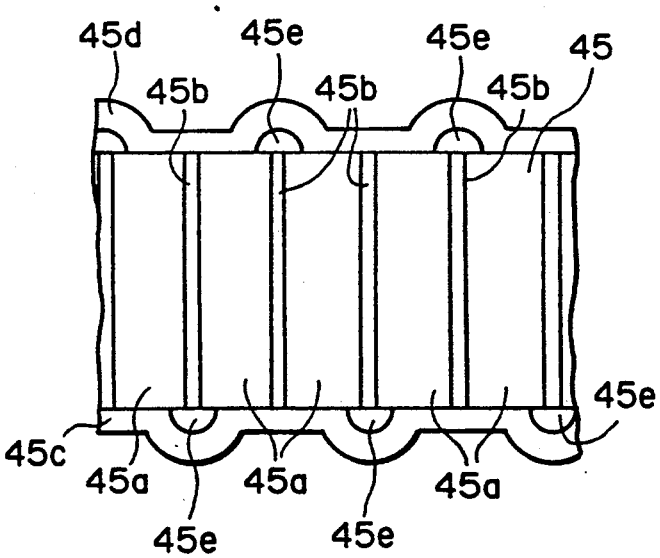
FIG. 4 is a partially enlarged cross-sectional view of the laminated piezoelectric element.

FIG. 3 shows another embodiment of the present invention. This piezoelectric actuator device comprises a laminated piezoelectric element 12. The laminated piezoelectric element 12 is longitudinally sandwiched by metal blocks 10 and 11 and first and second leaf springs 12 and 13 are provided between the metal blocks 10 and 11 to maintain the laminated piezoelectric element 12 in compression. The first and second leaf springs 13 and 14 are fixed to the opposite surfaces of the metal blocks 10 and 11. The laminated piezoelectric element 12 is similar to the laminated piezoelectric element 45 of FIG. 4, which comprises a plurality of thin piezoelectric plates 45*a* laminated together via intermediate electrode layers 45*b* arranged between the adjacent piezoelectric plates 45*a*, and side electrode layers 45*c* and 45*d* on the opposite sides of the laminated piezoelectric element to connect the alternating intermediate electrode layers 45*b* to the power source while insulating elements 12*e* are arranged in a staggered array.

In FIG. 4, the side electrode layer 45*d* is covered by the first leaf spring 13 and the side electrode layer 45*c* is covered by the second leaf spring 14. The first leaf spring 13 has an elongated aperture 60 and a lead 48 is passed through the elongated aperture 60 for connecting the upper side electrode layer and 45*d* to the power source. Also, the second leaf spring 14 has a similar elongated aperture 60 (not shown) and a lead 49 is passed through the elongated aperture 60 for connecting the lower side electrode layer 45*c* to the power source (not shown). It is possible according to the present invention that the first and second leaf springs 13 and 14 can be freely arranged over and below the upper and lower side electrode layers 45*c* and 45*d* of the laminated piezoelectric element 45, respectively, with a minimum gap between the first and second leaf springs 13 and the laminated piezoelectric element 45. Accordingly, it is possible to increase the design possibilities of the piezoelectric actuator device. It is also possible that a plurality of piezoelectric assemblies of the printing elements are arranged in a side-by-side relationship in a dense arrangement.

I claim:

1. A piezoelectric actuator device comprising:

a laminated piezoelectric element having first and second opposite ends and first and second opposite sides;

a first block located at the first end of the laminated piezoelectric element;

a second block located at the second end of the laminated piezoelectric element;

a first leaf spring arranged between the first and second blocks facing the first side of the laminated piezoelectric element; and a second leaf spring arranged between the first and second blocks facing the second side of the laminated piezoelectric element, the first and second leaf springs maintaining the laminated piezoelectric element in compression, the laminated piezoelectric element having a width measured on the first and second opposite sides and the first and second blocks and the first and second leaf springs have respective widths measured on the first and second opposite sides and the width of the laminated piezoelectric element is equal to or greater than the respective width of the first and second blocks and the first and second leaf springs, and a movement magnifying, one of the first and second blocks being fixed to a stationary base, and the other block being connected to the movement magnifying mechanism which is movable in a predetermined plane in response to the movement of the laminated piezoelectric element for magnifying the movement of the laminated piezoelectric element; the first and second opposite sides being perpendicular to the plane of the movement of the movement magnifying mechanism.

2. A piezoelectric actuator device as recited in claim 1, wherein the laminated piezoelectric element has at least one lead means extending therefrom to an external power source, and at least one of the first and second leaf springs have an aperture through which at least one lead means extends.

3. A piezoelectric actuator device according to claim 2, wherein the laminated piezoelectric element has an electrode layer on each of the first and second opposite sides, and at least one lead means extending from the electrode layer.

4. A piezoelectric actuator device according to claim 2, wherein the aperture is an elongated aperture.

* * * * *